US006499977B2

(12) United States Patent
Barito et al.

(10) Patent No.: US 6,499,977 B2
(45) Date of Patent: Dec. 31, 2002

(54) SCROLL COMPRESSOR WITH INTEGRAL OUTER HOUSING AND A FIXED SCROLL MEMBER

(75) Inventors: Thomas R. Barito, Arkadelphia, AR (US); Jason Hugenroth, Hope, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/897,187

(22) Filed: Jul. 2, 2001

(65) Prior Publication Data

US 2002/0006343 A1 Jan. 17, 2002

Related U.S. Application Data

(63) Continuation-in-part of application No. 09/556,563, filed on Apr. 24, 2000, now Pat. No. 6,264,443.

(51) Int. Cl.[7] ..... F01C 1/02

(52) U.S. Cl. ..... 418/55.1; 418/55.2; 418/83; 418/101; 418/179

(58) Field of Search ..... 418/55.1, 55.2, 418/179, 83, 101

(56) References Cited

U.S. PATENT DOCUMENTS

| | | | | |
|---|---|---|---|---|
| 2,841,089 A | | 7/1958 | Jones | |
| 3,884,599 A | | 5/1975 | Young | |
| 4,466,784 A | | 8/1984 | Hiraga | |
| 4,561,832 A | | 12/1985 | Shimizu | |
| 4,811,471 A | | 3/1989 | Etemad | |
| 4,929,160 A | | 5/1990 | Inoue | |
| 5,042,150 A | | 8/1991 | Fraser | |
| 5,098,265 A | | 3/1992 | Machida | |
| 5,201,646 A | | 4/1993 | Dees | |
| 5,228,196 A | | 7/1993 | Hara | |
| 5,247,738 A | | 9/1993 | Yoshii | |
| 5,267,844 A | * | 12/1993 | Grassbaugh et al. | 417/410 |

(List continued on next page.)

FOREIGN PATENT DOCUMENTS

| | | | | |
|---|---|---|---|---|
| EP | 798465 | * | 1/1997 | 418/55.1 |
| JP | 60-166782 | | 8/1985 | |
| JP | 02-049986 | * | 2/1990 | 418/55.1 |
| JP | 04-342801 | * | 11/1992 | 418/101 |
| JP | 05-149276 | * | 6/1993 | 418/101 |
| JP | 06-249165 | * | 9/1994 | 418/101 |
| JP | 06-249168 | * | 9/1994 | 418/101 |

*Primary Examiner*—Thomas Denion
*Assistant Examiner*—Theresa Trieu
(74) *Attorney, Agent, or Firm*—Carlson, Gaskey & Olds

(57) ABSTRACT

An improved housing for scroll compressor has the end cap housing formed integrally with the fixed scroll member. The end cap housing is preferably welded to a tubular housing enclosing the scroll compressor. Most preferably, the end housing has inner and outer tubular portions and the tubular housing extends upwardly into a channel between the inner and outer tubular portions. A muffler is preferably formed integrally with the end cap and extends to a side of the end cap. The present invention further includes heat transfer fins extend from the end cap. The positioning of the muffler to the side decreases the overall length of the compressor. The use of the fins increases the efficiency of compression as heat is removed from the compression chambers. The use of the unique combined end cap and fixed scroll which is welded to the tubular housing simplifies assembly. The invention also extends to an embodiment wherein the combined outer housing and fixed scroll are formed of two separate pieces with the first piece being formed of steel, and a second piece being formed of a material into which it will be more practical to machine the complex scroll wrap. In another embodiment, heat pipes are mounted into the end face of the outer housing to assist in conducting heat away from the fixed scroll.

10 Claims, 4 Drawing Sheets

U.S. PATENT DOCUMENTS 5,282,728 A 2/1994 Swain
5,328,340 A 7/1994 Hara
5,336,068 A 8/1994 Sekiya
5,342,185 A 8/1994 Anderson
5,346,374 A 9/1994 Guttinger
5,379,516 A 1/1995 Vaccaro
5,411,384 A * 5/1995 Bass et al. ..... 418/55.5
5,435,707 A * 7/1995 Hirano et al. ..... 418/55.5
5,466,134 A 11/1995 Shaffer
5,478,219 A 12/1995 Nardone
5,547,355 A * 8/1996 Watanabe et al. ..... 418/55.5
5,564,186 A 10/1996 Hori
5,607,288 A 3/1997 Wallis
5,616,015 A 4/1997 Liepert
5,632,610 A 5/1997 Tsubokawa
5,641,278 A 6/1997 Tsumagari
5,775,888 A * 7/1998 Sakamoto et al. ..... 418/101
6,158,989 A 12/2000 Barito
6,193,484 B1 * 2/2001 Hahn et al. ..... 418/55.1

* cited by examiner

Fig-1
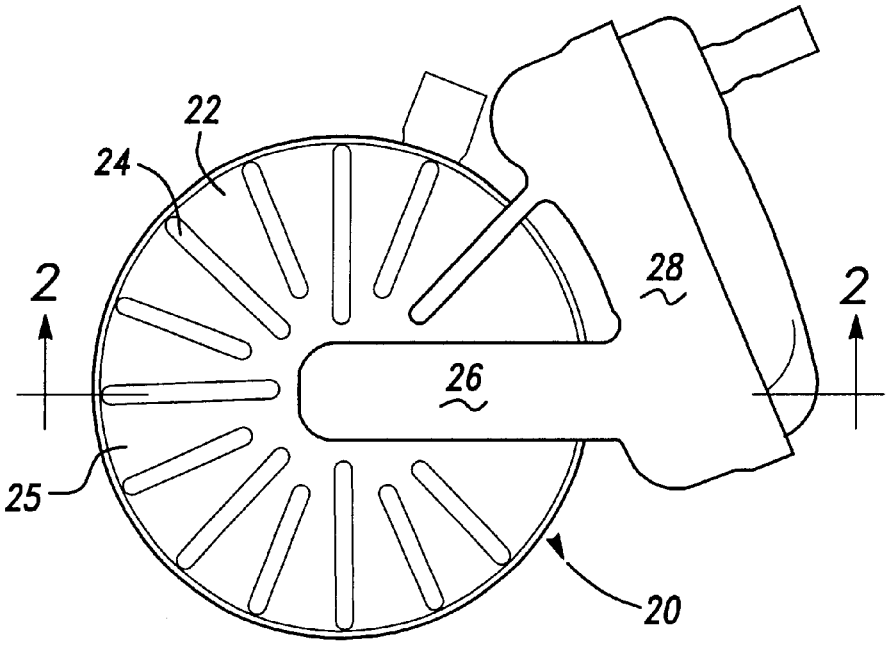
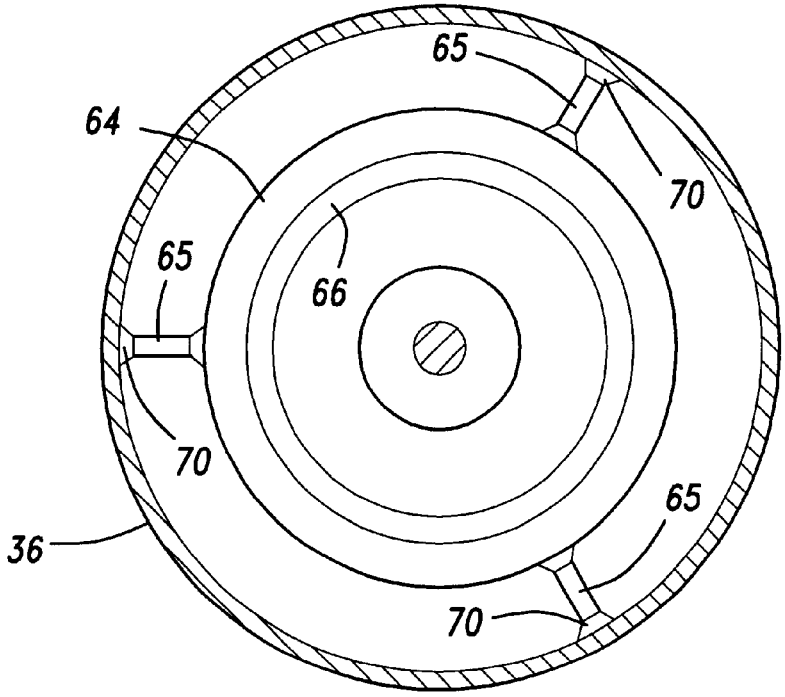
Fig-4

SCROLL COMPRESSOR WITH INTEGRAL OUTER HOUSING AND A FIXED SCROLL MEMBER

This is a Continuation-in-part of Ser. No. 09/556,563, filed Apr. 24, 2000, now U.S. Pat. No. 6,264,443.

BACKGROUND OF THE INVENTION

This invention relates to improvements in scroll compressor housings.

Scroll compressors are being utilized in many refrigerant compression operations, since they have many functional benefits when compared to other types of compressors. Thus, scroll compressors are becoming adopted by the compression industry for many applications. There are challenges, however, with scroll compressors.

Typically, a scroll compressor consists of a fixed scroll having a base with a generally spiral wrap extending from the base towards an orbiting scroll. The orbiting scroll has a base with a spiral wrap extending towards the fixed scroll. The orbiting scroll orbits relative to the fixed scroll and compression chambers between the intermeshing scroll wraps are compressed.

It is a desire of the scroll compression industry to minimize the size of the scroll compressor. In particular, it is desirable to minimize the axial length of the scroll compressor. Further, it has been a challenge to remove heat from the scroll compression chambers. Typically, in a sealed scroll compressor, the fixed scroll is mounted at some distance away from an outer housing. Thus, the outer housing is exposed to the ambient environment, but the fixed scroll is separated from the ambient environment, and thus has been somewhat difficult to cool.

The prior art has proposed combining the fixed scroll with the outer housing. However, in general, these designs have proposed bolting the combined fixed scroll and outer housing to a second housing along interface planes. With such a combination it would be difficult to achieve proper positioning of the scroll members, as there is no adjustability provided. Moreover, it is not believed these proposals have ever been in production. To the extent they have, they would be very difficult to assemble.

SUMMARY OF THE INVENTION

In a disclosed embodiment of this invention, a scroll compressor comprises a fixed scroll formed integrally with an outer housing. The compressor is preferably in a sealed canister with a generally tubular housing welded to the combined outer housing and fixed scroll. Preferably, the outer housing is positioned on a radially outer surface of the tubular housing and welded.

More preferably, a muffler is formed integrally with the combined housing and fixed scroll. The muffler preferably extends to the side of the compressor such that it does not increase the overall axial length. Fins also extend from the combined housing and fixed scroll in a direction away from the fixed scroll wrap. The fins provide cooling to remove heat from the compression chambers. Preferably, the muffler and the fins extend away from the base of the fixed scroll member for an approximately equal distance.

In a most preferred embodiment, the combined housing and fixed scroll includes inner and outer tubular portions with the tubular housing member fitting between the inner and outer portions. The tubular housing member can move into and out of a channel formed between the inner and outer tubular portions to allow relative adjustment of the position of the housings. In this way, the position of the scroll members can be carefully controlled. Other housing would also come within the scope of this invention. As one example, only the inner portion need be utilized, with the outer guide portion being eliminated. The tubular housing would still be guided along the inner guide portion and welded.

In a method of assembling the scroll compressor according to this invention, a pump unit is initially assembled by securing the main crankcase bearing to the combined fixed scroll and outer housing. The orbiting scroll is captured between the crankcase and the fixed scroll. This subassembly is then welded to the tubular housing member. Thus, the main crankcase bearing is directly and rigidly secured to the outer housing through this outer weld joint. This provides additional strength to the bearing attachment.

In further embodiments of this invention, the one piece fixed scroll and outer housing may be preferably formed of two parts. A cast iron portion may form the fixed scroll, while a steel portion forms the outer housing. The cast iron portion is preferably pressed into the outer housing, with a generally planar interface between the two ensuring the two will be in tight contact to ensure proper positioning and good heat transfer. This two-piece part will be beneficial in that forming the entire combined member of the cast steel could be costly, and it may be difficult to cast the thin scroll wraps. It potentially also may be complicated to machine steel wraps. Thus, having the two-piece part, provides the outer housing formed of steel, with the scroll wraps formed of a more easily machined material such as cast iron or aluminum.

In a further embodiment of this invention, heat pipes are attached to the outer surface of the one-piece fixed scroll and outer housing. The heat pipes are preferably utilized in combination with fins which attach to the several heat pipes. Further, the condenser fan may be mounted adjacent to the end of the housing such that the fan will draw air over the heat pipes and fins. While heat pipes are shown as the heat exchanger attached to the outer surface of the fixed scroll and outer housing, it should be understood that other separate heat exchangers attached to the housing would come within the scope of this invention.

These and other features of the present invention can be best understood from the following specification and drawings, the following of which is a brief description.

BRIEF DESCRIPTION OF THE DRAWINGS

FIG. 1 is a top view of an inventive scroll compressor.

FIG. 4 is a cross-sectional view along line 4—4 of FIG. 2.

DETAILED DESCRIPTION OF THE PREFERRED EMBODIMENT

Figure 2:
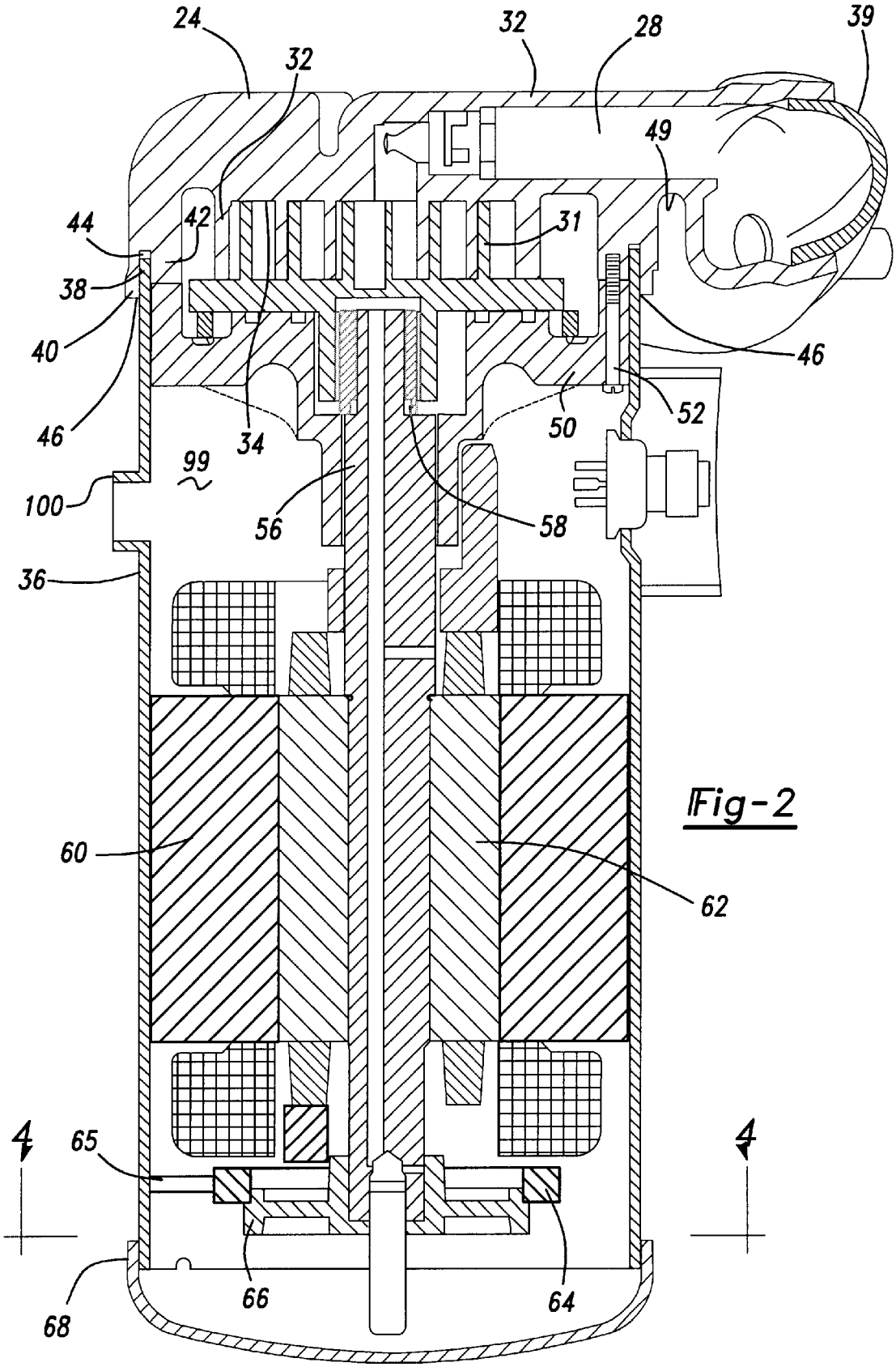
FIG. 2 is a cross-sectional view along line 2—2 of FIG. 1.

An improved scroll compressor 20 is shown in FIG. 1 having an outer housing 22 with fins 24 extending away from a nominal surface plane 25. An outlet passage 26 extends towards a side of the housing 22 and into muffler 28.

As can be seen in FIG. 2, muffler 28 has a top end 32 that is approximately at the same distance as the top of the fins 24. As shown, the muffler is integral with housing 22, and may include a separate cover 39. In this way, the muffler 28 does not add unduly to the axial length of the overall compressor 20. The fins 24 serve to remove heat from the compression chambers within the compressor. Due to the combined outer housing and fixed scroll the fins are very close to the compression chambers, such that they can provide efficient cooling.

Fixed scroll wrap 32 extends from a base 34 formed integrally with outer housing 22. The orbiting scroll 31 interfits with the fixed scroll wrap 32 to define compression chambers, as is known. A tubular housing 36 is welded to outer housing 22. As shown, an end 38 of the tubular housing 36 extends upwardly between inner tubular portion 42 and outer tubular portion 40 of outer housing 22. The inner and outer tubular portions 40 and 42 minimize distortion in the fixed scroll wrap 32.

As shown, the clearance 44 is formed forwardly of end 38. Thus, the end 38 could extend further into the channel if necessary to achieve proper axial positioning.

As also shown in FIG. 2, a notch 49 serves to provide a thermal break between the muffler 28 and the compression chambers. This ensures that there will not be a good deal of heat migration from the muffler 28 back to the compression chambers during operation of the compressor. Also, the cover 39 is preferably welded to the muffler. During this welding operation, the notch 49 also serves as a thermal break to prevent damage to the compressor component.

In assembling this invention, the main crankcase bearing 50 is initially attached to the outer housing 22 as by bolts 52. The sub-assembly, which would include the main crankcase bearing 50, the orbiting scroll member 31 and the combined fixed scroll and outer housing 22 are then moved into the tubular shell 36. Also, as known, an anti-rotation coupling would be included.

As further shown in FIG. 2, the flow of a suction refrigerant into a chamber 99 surrounding the motor is facilitated through a suction tube 100. Refrigerant passes through the suction tube 100 into chamber 99 and then into compression chambers defined between the two scroll members.

Figure 3:
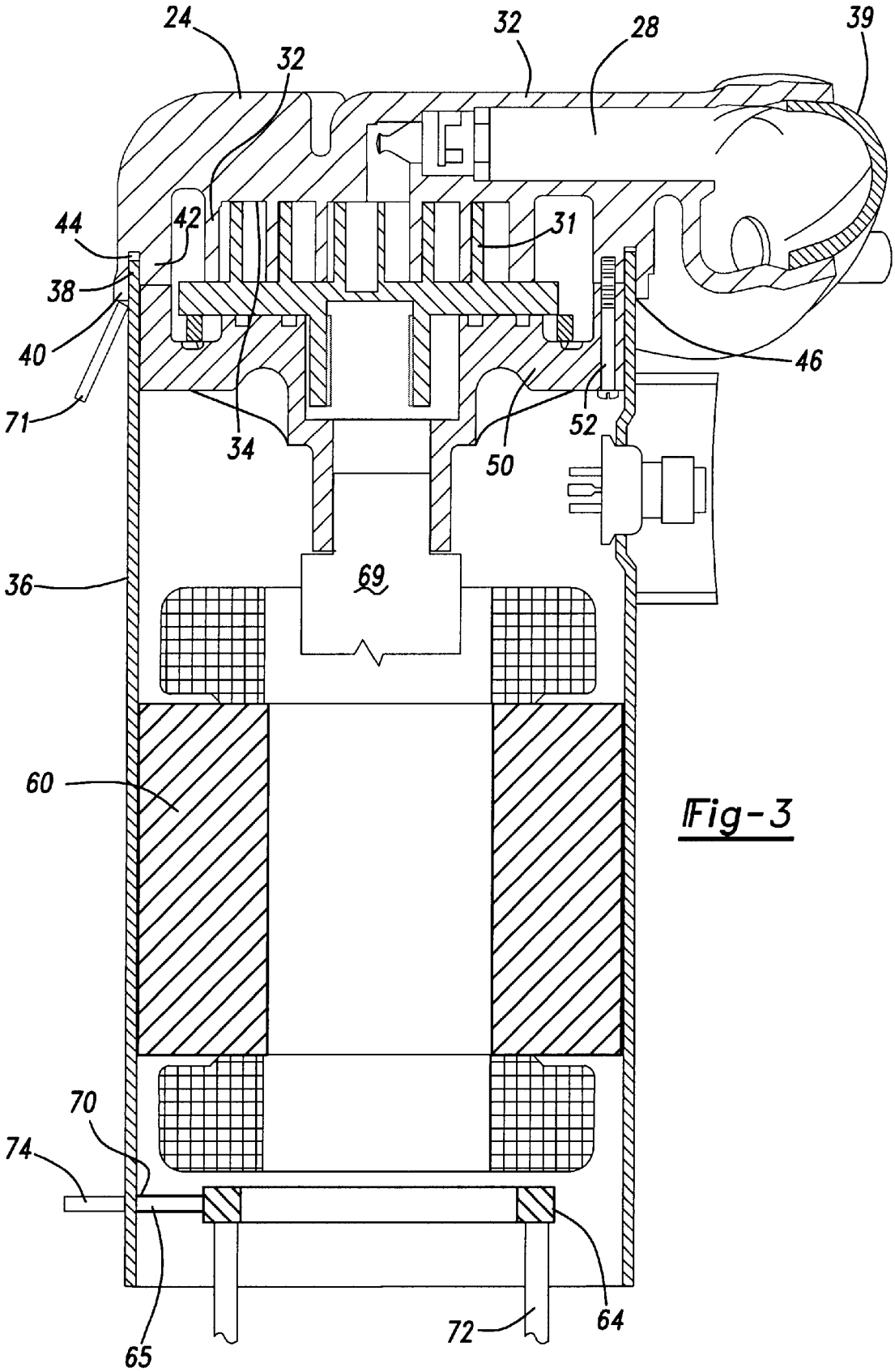
FIG. 3 is a cross-sectional view of an intermediate assembly step.

As shown in FIG. 3, a positioning jib 69, shown schematically initially holds the main crankcase bearing to position the pump sub-assembly prior to welding of the weld joint 46. A shown, a welded tool 71 forms weld joint 46 as jig 69 supports the sub-assembly.

As also shown in FIG. 2, a shaft 56 has a shaft bearing 58 for driving the orbiting scroll 31. As can be appreciated from FIG. 3, this shaft and bearing sub-assembly is not received in the pump assembly when it is being attached to the tubular housing 36.

The motor stator 60 is initially attached to the tubular shell, as shown in FIG. 3. At this time, the motor rotor 62, which is fixed to the shaft 56 is not received within the tubular housing 56.

A lower bearing support 64 has a plurality of arms 65 which are attached to an inner peripheral surface of tubular housing 36. The lower bearing 66 is not received in the housing at the time the lower bearing support 64 is attached. Instead, as shown, a jig 72 is utilized to position and hold the lower bearing support 64 while the arms 65 are welded to the inner peripheral surface of the tubular housing 36 by weld tool 74 extending into an opening in housing 36. Jigs 72 and 69 are shown somewhat schematically.

As shown in FIG. 4, there are preferably several circumferentially spaced arms 65 welded at 70 to housing 30.

Once the crankcase 50 and bearing support 64 have been welded to the tubular housing 36, the jigs 69 and 72 are removed. At that time, the shaft 56, bearing 58 and motor stator 62 and lower bearing 66 can all be moved into the housing. At that time, the lower housing cover 68 may be placed onto the housing to enclose the sealed compression chamber.

By welding the pump sub-assembly directly to the tubular housing 36 the present invention provides a more secure and rigid attachment of the crankcase bearing 50 to the housing 36.

In summary, the present invention discloses a scroll compressor in which the assembly is greatly simplified. Moreover, the required axial length is decreased. The invention also facilitates the removal of heat from the compression chambers, and thus improves overall efficiency. Finally, the attachment method of this invention ensures that there is a more rigid connection of the crankcase bearing to the tubular housing 36, and thus an improved assembly.

Figure 5:
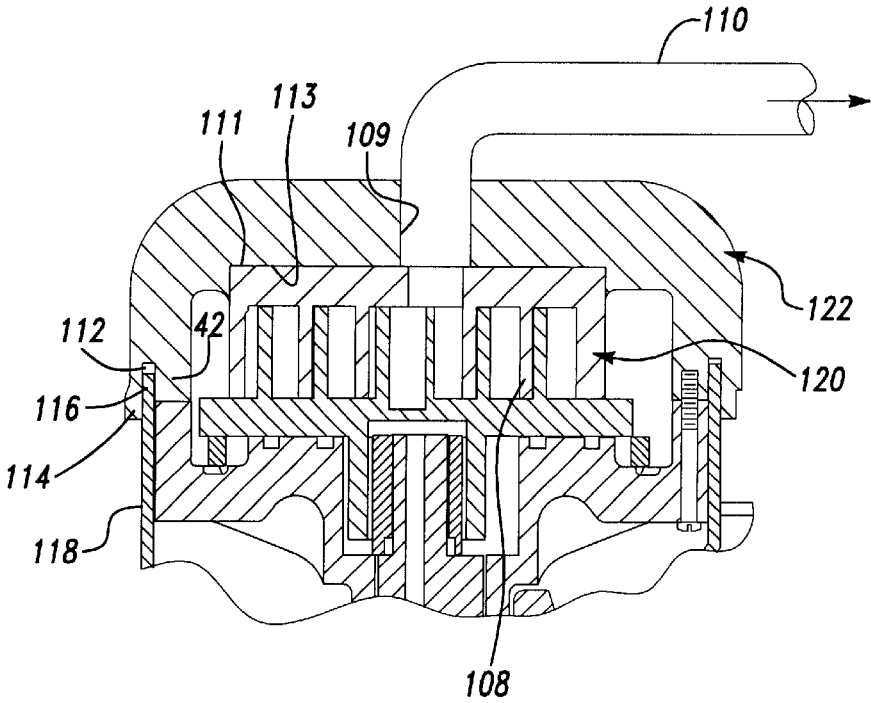
FIG. 5 shows another embodiment.

An embodiment shown in FIG. 5 incorporates a discharge tube 110 brazed into an opening 109 in a first outer housing member 122. An inner member 120 includes the scroll wraps 108, and has an end face 111 abutting a planar end face 113 of the outer housing 122. The connection 112, 114, 116 and 118 of the center shell upwardly into a channel in the outer member 122 may be generally as in the above embodiments. Notably, this connection occurs in the outer housing member. This embodiment allows the outer housing member 122 to be formed of a material such as steel with the scroll wraps 108 formed in an inner member 120 formed of a material such as cast iron or aluminum which may be more easily utilized to form the complex scroll wrap. With this invention, the overall goal of the one-piece fixed scroll and outer housing can be achieved in a more easily manufactured product.

Figure 6:
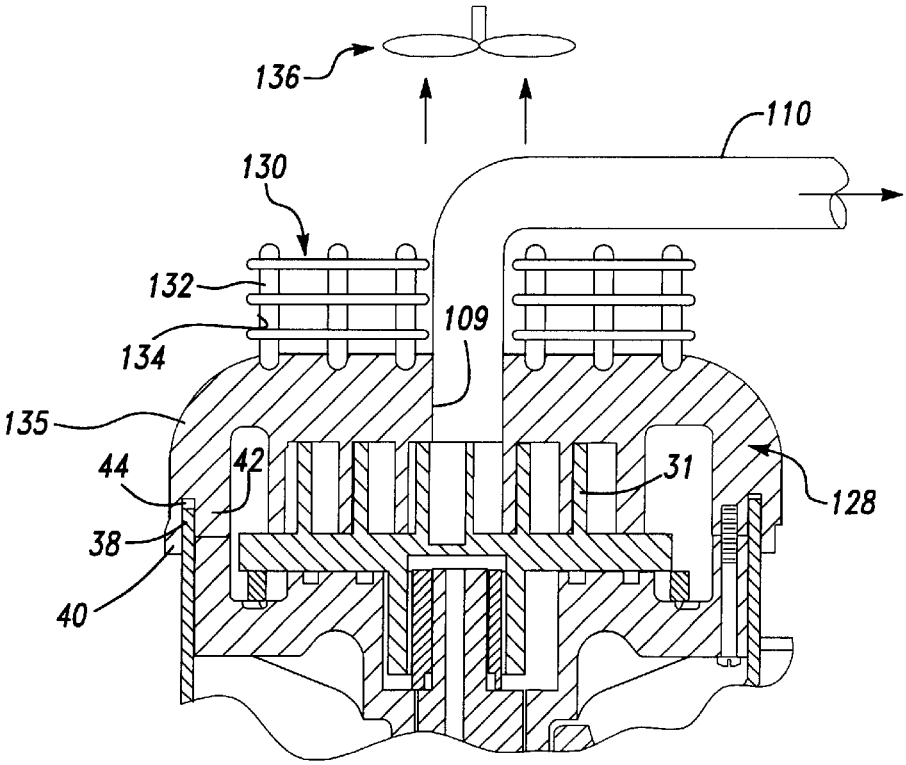
FIG. 6 shows yet another embodiment.

FIG. 6 shows another feature 128 wherein heat pipes 132 are mounted in grooves 134 in an outer portion of the combined outer housing 135 and fixed scroll. The heat pipes may be configured of materials such as are used in laptop computer heat pipes. Of course, this embodiment may be used in combination with the features of FIG. 5 embodiment or any of the other features. Again, the discharge tube 110 is mounted within an opening 109. Further, fins 130 may connect the several heat pipes 132 to better take away heat from the part 135. Finally, the condenser fan 136 may be positioned such that it will draw air over the fins 130 and heat pipes 132. It is known that heat pipes conduct heat away from a source of heat to a much greater extent than fins or other heat transfer structures. Thus, the use of heat pipes in this embodiment will provide valuable benefits. This feature facilitates heat removal particularly during a problem operation such as reverse rotation operation. The removal of heat becomes particularly important in smaller compressors. While heat pipes are shown as the heat exchanger attached to the outer surface of the fixed scroll and outer housing, it should be understood that other separate heat exchangers attached to the housing would come within the scope of this invention.

Preferably, the combined fixed scroll and outer housing is made of a cast steel, or from a composite casting which includes a cast iron body with a cast in steel outer ring. Alternatively, the housing could be formed entirely of cast iron. The tubular housing 36 is preferably formed of steel, and it is desirable to have a steel-to-steel weld joint. For that reason, it is preferable that the combined outer housing and fixed scroll be formed of a cast steel material.

A worker of ordinary skill in the art would recognize that certain modifications would come within the scope of this invention. For that reason, the following claims should be studied to determine the true scope and content of this invention.

What is claimed is:

1. A scroll compressor comprising:

a housing extending along an axis, and enclosing an electric motor, a driveshaft driven by said motor, and an orbiting scroll for orbiting when said motor drives said driveshaft;

a fixed scroll, said orbiting and fixed scrolls each having a base and a generally spiral wrap extending from said base, said wraps interfitting to define compression chambers, said fixed scroll being formed as a single piece with an outer housing, said outer housing being welded to a center shell for defining said housing; and a suction tube for communicating refrigerant into a suction chamber surrounding said motor, said suction chamber then communicating with said compression chambers to allow refrigerant to pass into said suction chamber and then to said compression chambers, and from said compression chambers outwardly through a discharge port formed in said combined outer housing and fixed scroll and from said discharge port directly into a discharge tube, said discharge tube extending outwardly of said combined outer housing and fixed scroll.

2. A scroll compressor as recited in claim 1, wherein said combined outer housing and fixed scroll includes two pieces, with a planar face being formed in abutting contact between said two pieces, an outer portion being welded to said center shell and formed of steel, and an inner portion providing said scroll wrap and formed of a material which may be more easily machined than steel.

3. A scroll compressor as recited in claim 2, wherein said material of said portion which forms said scroll wraps is cast iron.

4. A scroll compressor as recited in claim 2, wherein said discharge tube is brazed into an opening in said outer housing.

5. A scroll compressor comprising:

a housing extending along an axis, and enclosing an electric motor, a driveshaft driven by said motor, and an orbiting scroll for orbiting when said motor drives said driveshaft;

a fixed scroll, said orbiting and fixed scrolls each having a base and a generally spiral wrap extending from said base, said wraps interfitting to define compression chambers, said fixed scroll being formed as a single piece with an outer housing, said outer housing being welded to a center shell for defining said housing;

a suction tube for communicating refrigerant into a suction chamber surrounding said motor, said suction chamber then communicating with said compression chambers to allow refrigerant to pass into said suction chamber and then to said compression chambers, and from said compression chambers outwardly through a discharge port formed in said combined outer housing and fixed scroll; and a heat exchanger is attached to an outer surface of said combined outer housing and fixed scroll.

6. A scroll compressor as recited in claim 5, wherein heat pipes are attached to an outer surface of said combined outer housing and said fixed scroll.

7. A scroll compressor as recited in claim 6, wherein a plurality of heat transfer fins connect said heat pipes.

8. A scroll compressor comprising:

a housing extending along an axis, and enclosing an electric motor, a driveshaft driven by said motor, and an orbiting scroll for orbiting when said motor drives said driveshaft;

a fixed scroll, said orbiting and non-orbiting scroll each having a base and a generally spiral wrap extending from said base, said wraps interfitting to define compression chambers, said fixed scroll being formed as a single piece with an outer housing, said outer housing being welded to a center shell for defining said housing; and a heat exchanger attached to an outer surface of said combined outer housing and fixed scroll, said heat exchanger being separate from said combined outer housing and fixed scroll.

9. A scroll compressor as recited in claim 8, wherein said heat exchanger includes heat pipes.

10. A scroll compressor as recited in claim 9, wherein a plurality of heat transfer fins connect said heat pipes.

* * * * *